United States Patent [19]

Liu

[11] 4,344,737

[45] Aug. 17, 1982

[54] CROSSOVER DUCT

[75] Inventor: Hsin-Tuan Liu, Scottsdale, Ariz.

[73] Assignee: The Garrett Corporation, Los Angeles, Calif.

[21] Appl. No.: 873,638

[22] Filed: Jan. 30, 1978

[51] Int. Cl.[3] ..... F01D 9/02

[52] U.S. Cl. ..... 415/199.1; 415/211

[58] Field of Search ..... 415/198.1, 199.2, 181, 415/199.1, 211, 219 C; 138/39, 155

[56] References Cited

U.S. PATENT DOCUMENTS

| | | | |
|---|---|---|---|
| 871,341 | 11/1907 | Jaeger | 415/199.2 X |
| 2,063,194 | 12/1936 | Roy | 415/198.1 X |
| 2,303,949 | 12/1942 | Nordell | 138/39 |
| 2,661,594 | 12/1953 | Petrie | 415/199.1 X |
| 3,044,684 | 7/1962 | Fullemann | 415/199.2 |
| 3,706,510 | 12/1972 | O'Connor | 415/145 |
| 3,797,085 | 3/1974 | Aartman | 29/156.8 R |
| 3,927,763 | 12/1975 | Strub et al. | 415/199.2 X |
| 3,964,837 | 6/1976 | Exley | 415/181 |
| 4,027,997 | 6/1977 | Bryans | 415/207 |
| 4,087,200 | 5/1978 | Korenblit et al. | 415/199.2 |

FOREIGN PATENT DOCUMENTS

| | | | |
|---|---|---|---|
| 807932 | 1/1937 | France | 415/199.2 |
| 1002707 | 3/1952 | France | 415/181 |

*Primary Examiner*—Everette A. Powell, Jr.
*Attorney, Agent, or Firm*—Stuart O. Lowry; Albert J. Miller

[57] ABSTRACT

A crossover duct for providing flow communication between multiple stages of centrifugal compressors and the like. The duct forms a continuous annular path between compressor stages for turning radially outward gas flow to a radially inward direction. The duct includes thin diffuser vanes having aerodynamically contoured leading edges, and a vaneless turning bend having a generally elliptical wall geometry.

20 Claims, 6 Drawing Figures

CROSSOVER DUCT

BACKGROUND OF THE INVENTION

The invention of this application is related in subject matter to concurrently filed application Ser. No. 873,639, entitled "Crossover Duct Assembly" in the name of Hsin-Juan Lui.

This invention relates to machines such as turbine engines and the like including multiple stage compressors. More specifically, this invention relates to a pneumatic crossover duct for providing flow-efficient communication between adjacent stages of a multiple stage compressor.

In the prior art, multiple stage compressors are found in a wide variety of applications. For example, a dual or multiple stage compressor is commonly used for supplying compressed charge air to a combustor section of a turbine engine. That is, ambient air is compressed by a first compressor, and then ducted to a second or subsequent compressor for obtaining increasingly higher levels of compression. Then, the highly compressed charge air is supplied to the engine combustor section including a combustion chamber for admixture with a suitable turbine fuel. The air-fuel mixture in the combustion chamber is ignited, and the hot products of combustion are utilized to rotate one or more turbine wheels at high speeds to obtain a relatively high power engine output.

In many multiple stage compressors, one or more centrifugal-type compressor wheels are commonly used. Such compressor wheels function to convert an axially entering gas stream into a radially outwardly directed compressed stream. With centrifugal compressor wheels, a generally annular pneumatic crossover duct is necessarily provided between compressor stages for turning the compressed gas from a radially outward direction back toward the next compressor stage in series for further compression. In such pneumatic crossover ducts, aerodynamic considerations are of high importance in that it is desirable to couple the compressed gas stream to subsequent compressor stages with a minimum of flow turbulence, and with a minimum of efficiency losses and a minimum of pressure losses.

Crossover ducts found in the prior art typically comprise an annular duct having a generally U-shaped cross section for turning a radially outward gas flow to a radially inward direction. A series of circumferentially spaced vanes are often included in the curved end portion, or turning bend, of the duct for assisting in turning the gas flow. See, for example, U.S. Pat. No. 3,361,073. The use of such turning vanes assists in reducing some flow turbulence, but it has been found that turning vanes also tend to interfere with gas flow and thereby create undesirable pressure losses. Accordingly, some prior art crossover duct constructions omit the turning vanes. See, for example, U.S. Pat. Nos. 2,661,594 and 2,620,626. However, even without turning vanes, prior art crossover ducts have been formed on a radial configuration which has been found to enhance undesirable boundary layer flow conditions resulting in undesirable efficiency losses.

Some prior art crossover duct constructions have included a series of circumferentially spaced diffuser blades or vanes in the gas entrance portion of the duct upstream of the turning bend for purposes of enhancing smooth gas flow. Typically, these diffuser blades comprise relatively sturdy blades having a substantially planar or slightly arcuate configuration within the duct to guide the compressed swirling gas flow in a radially outward direction. See, for example, U.S. Pat. Nos. 2,797,858; 2,827,261; 2,967,013 and 3,409,340. Prior art diffuser blades have been formed relatively thick to provide structural rigidity between the inner and outer walls of the crossover duct, and are typically anchored in the desired position by bolts, pins, or the like. However, for optimum aerodynamic performance it is desirable to provide a sturdy crossover duct construction which does not reply upon the diffuser vanes for structural rigidity, but instead uses relatively thin diffuser vanes shaped for minimum pressure losses and which may be formed from a relatively inexpensive and commercially available sheet material.

This invention overcomes the problems and disadvantages of the prior art by providing a structurally sound crossover duct construction having a vaneless turning bend configured to maximize efficiency and to minimize pressure losses, and including thin diffuser vanes shaped aerodynamically for improved flow efficiency and reduced pressure loss characteristics.

SUMMARY OF THE INVENTION

In accordance with the invention, a pneumatic crossover duct for directing compressed gas between a pair of compressor stages comprises an inner wall and an outer wall cooperating to form an annular gas flow passage having a generally U-shaped cross section. Specifically, the inner and outer walls of the duct comprise a flow path communicating with the first compressor stage, and extending radially outwardly into a curved end portion, or turning bend, of generally about 180°. From turning bend, the inner and outer duct walls blend into a radially inwardly directed gas flow path extending radially inwardly toward the second compressor stage.

A plurality of radially extending and aerodynamically thin diffuser vanes are circumferentially spaced around the duct between the first compressor stage and the turning bend. Each diffuser vane has a thin substantially uniform thickness along its length, and its width spans axially between the duct inner and outer walls to help direct swirling compressed gas entering the duct in a radially outward direction. The leading edges of the diffuser vanes are aerodynamically contoured to provide a leading edge wedge angle of about two or more degrees to reduce the incidence of the flow with respect to the suction surfaces of the vanes, and thereby reduce diffuser pressure loss and extend diffuser range.

The turning bend of the crossover duct is shaped with an elongated inner and outer wall geometry to improve flow efficiency and to reduce pressure losses. Specifically, the inner wall and the outer wall are both shaped to have a modified semi-elliptical geometry, whereby both walls are elongated compared to a conventional radial curvature. The outer wall and the inner wall of the turning bend each comprise an entrance quadrant and an exit quadrant, whereby the walls of the turning bend each have a generally semi-elliptical configuration. Importantly, the ratio of the major axis to the minor axis is at least about 1.20 for each inner wall quadrant, and at least about 1.15 for each outer wall quadrant.

BRIEF DESCRIPTION OF THE DRAWINGS

The accompanying drawings illustrate the invention. In such drawings.

DETAILED DESCRIPTION OF THE PREFERRED EMBODIMENT

Figure 1:
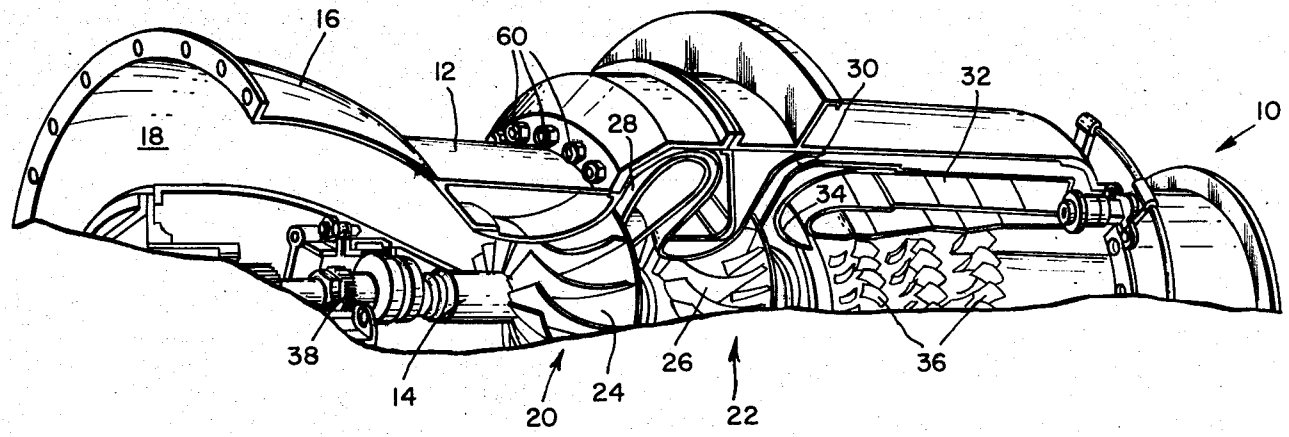
FIG. 1 is a fragmented perspective view of a turbine engine broken away to show a crossover duct of this invention.

A turbine engine 10 is shown in FIG. 1, and generally comprises a cylindrical engine housing 12 in which is mounted a longitudinally extending power shaft 14. The housing 12 has its forward end 16 flared outwardly to form an open air inlet 18 for passage of air through a pair of axially aligned compressor stages 20 and 22, respectively. The compressor stages 20 and 22 comprise centrifugal compressor wheels 24 and 26 mounted on the power shaft 14 for rotation therewith. Alternately, the latter compressor 22 may comprise an axial compressor if desired. Air supplied to the first centrifugal compressor wheel 24 is compressed and discharged radially outwardly into a crossover duct 28 of the invention. The crossover duct 28 serves to turn the radially outwardly directed air to a radially inward direction for axial supply to the second compressor wheel 26. The second wheel 26 further compresses the air, and discharges the air outwardly through a duct 30 leading to a combustion chamber 32. In the combustion chamber 32, the air is mixed with a suitable fuel and ignited whereupon the hot exhaust products are directed through a duct 34 to rotatably drive a series of turbine wheels 36 mounted on the shaft 14. Output for the engine may be taken via a gear 38 on the shaft 14, or alternately, in the form of thrust as in a jet propulsion aircraft engine.

Figure 2:
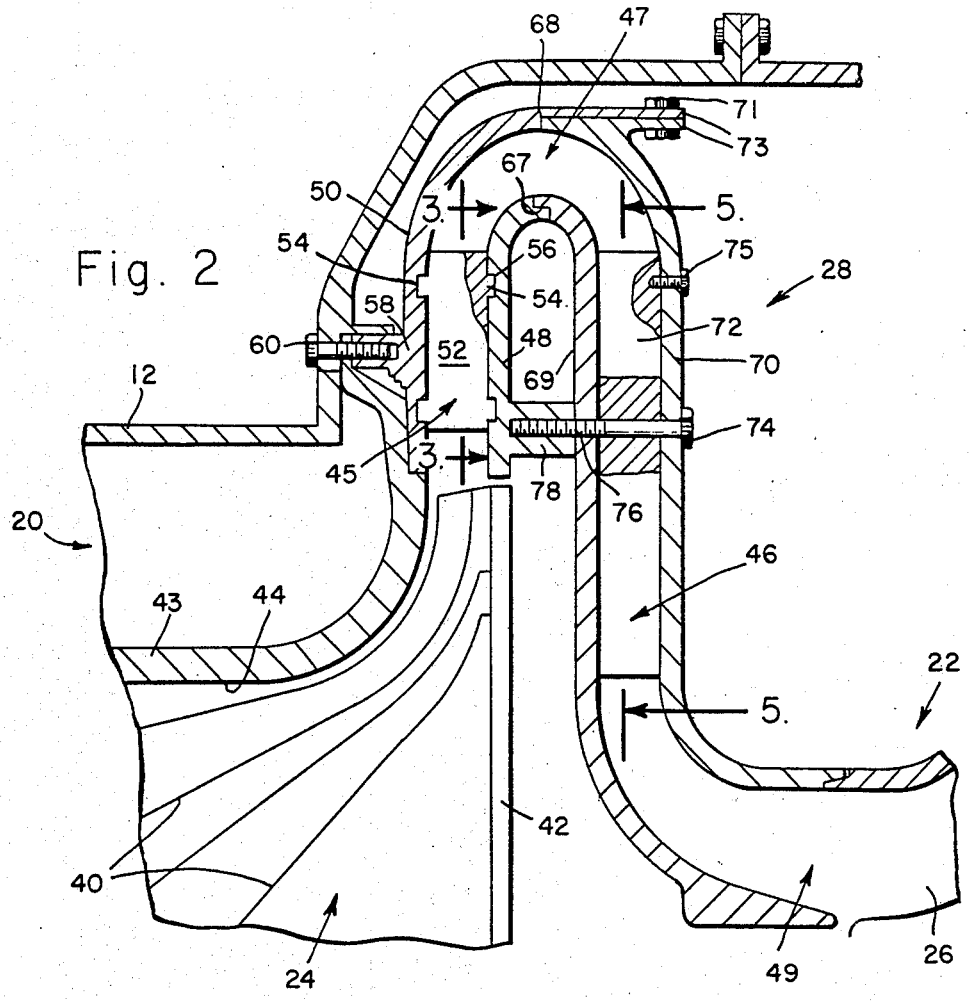
FIG. 2 is an enlarged fragmented section of the crossover duct.

As shown in FIG. 2, the first compressor wheel 24 comprises a plurality of forwardly-facing impeller blades 40 formed integrally with a circular backing plate 42. The plate 42 and a shroud 43 mounted on the engine housing 12 together form a chamber 44 for the first compressor stage 20. As the compressor wheel 24 is rotated on the power shaft 14, air is drawn through the inlet 18 axially into the compressor wheel 24. The air is compressed by the impeller blades 40, and is discharged radially outwardly about the circumference of the wheel 24 into the crossover duct 28 of this invention.

The crossover duct 28 comprises a continuous annular passage providing flow communication between the two compressor stages 20 and 22. More specifically, the crossover duct 28 has a gas entrance portion defining a radially outwardly directed gas flow path 45 blending into a generally U-shaped turning bend 47 for turning the swirling, radially outwardly directed gas flow back toward a radially inward direction. The turning bend 47 in turn blends with a gas exit portion defining a radially inwardly directed gas flow path 46 which guides the compressed gas flow inwardly toward the second compressor wheel 26. Of course, as shown, the radially inwardly directed flow path 46 may terminate in an axially turned portion 49 for supplying the compressed gas axially to the second compressor wheel 26.

Figure 3:
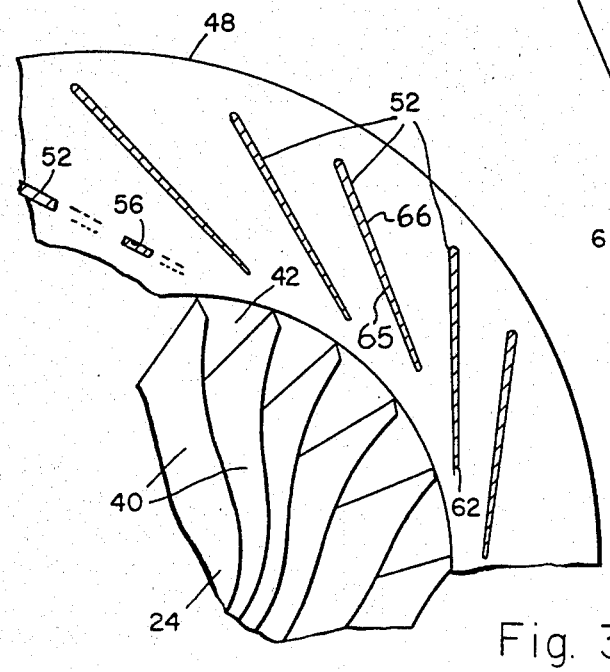
FIG. 3 is an enlarged vertical section taken on the line 3—3 of FIG. 2.
Figure 4:
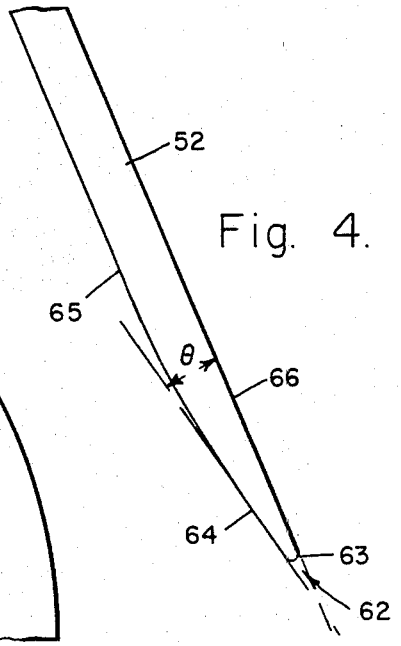
FIG. 4 is an enlarged fragmented elevation view of a portion of a thin diffuser vane of the duct of this invention.

The gas entrance portion of the crossover duct 28 comprises an annular inner wall 48 and an annular outer wall 50. The walls 48 and 50 are spaced from each other to form the radially outward flow path 45, and position and support a plurality of circumferentially spaced thin diffuser vanes 52 as shown in FIGS. 2 through 4. These vanes 52 each have tabs 54 on opposite sides received in pre-formed slots 56 in said walls 48 and 50. Or, if desired, the diffuser blades 52 may be fastened to the walls 48 and 50 as by brazing, or by other suitable mounting techniques. Finally, the outer wall 50 includes a plurality of circumferentially spaced, exteriorly facing bosses 58 into which a plurality of bolts 60 are threadably received to secure the entire gas entrance portion with respect to the engine housing 12, and to align the walls 48 and 50 to receive the compressed air discharged from the first compressor stage 20.

As shown in FIGS. 3 and 4, the diffuser vanes 52 are angularly set with respect to the radially outward direction of air flow through the crossover duct 28. The angular positions of the diffuser vanes 52 are selected to assist in turning the swirling compressed air flow exiting the first compressor wheel 24 to flow in a radially outward direction, and to help remove circumferential components of air velocity. Importantly, as shown in FIG. 4, the diffuser vanes are thin, and the leading edge 62 of each diffuser vane 52 is aerodynamically contoured with respect to the remainder of the vane length to form a leading edge wedge angle $\theta$ of at least about two degrees or more, and preferrably between about four to ten degrees. More specifically, the thin vanes have a length on the order of at least about seventy-five times their maximum thickness, and the leading edge of each vane is formed to have a rounded nose 63 preferrably having a thickness of about one-half the vane thickness or less. The nose 63 of each leading edge is formed adjacent the pressure surface 66 of the vane whereby an angularly disposed contoured surface 64 is formed adjacent the leading edge 62 on the vane suction surface 65. As illustrated in FIG. 4, this contoured surface is formed generally at angle $\theta$ with respect to the vane pressure surface 66, and thereby defines the vane leading edge wedge angle. In a preferred embodiment of the invention, the contoured surface 64 is generally a portion of an ellipse, although it may approach a straight line configuration. This shaping of the diffuser vane leading edges has been found to improve the smoothness of air flow through the crossover duct by reducing the incidence of air flow upon the vane suction surface. Conveniently, this aerodynamic contouring of the diffuser vane has been found to work equally well with single or multiple-row diffuser vane constructions.

As shown in FIG. 2, the inner and outer walls 48 and 50 of the duct extend radially outwardly in parallel from the compressor wheel 24, and then curve together into the turning bend 47 to form one-half, or about 90°, of the turning bend. The inner and outer walls 48 and 50 include shaped ends 67 and 68 for matingly engaging and abutting inner and outer walls 69 and 70, respectively, forming the radially, inward flow path 46, and thereby forming the remainder of the continuous, U-shaped duct passage. That is, the inner and outer walls 69 and 70 about the associated walls 48 and 50, and then curve radially inwardly in parallel to complete the second half of the turning bend 47 and to form the radially inward flow path 46.

Figure 5:
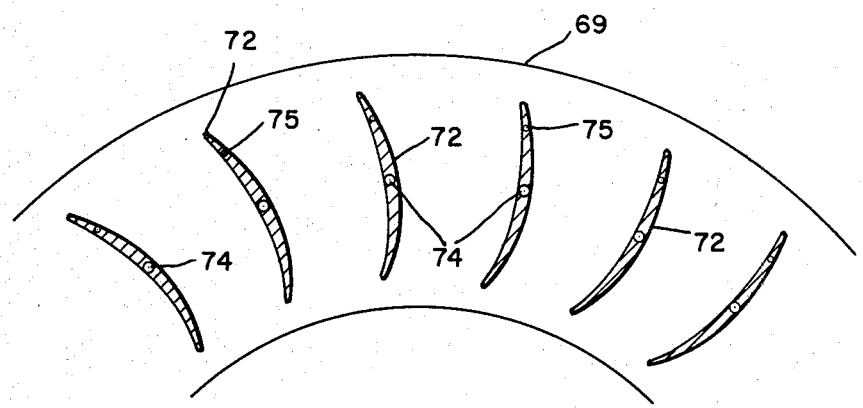
FIG. 5 is an enlarged vertical section taken on the line 5—5 of FIG. 2.

The inner and outer walls 69 and 70 of the duct exit portion are maintained in a predetermined parallel spatial relationship by a plurality of circumferentially spaced deswirl vanes 72. More specifically, as shown in FIG. 5, each deswirl vane 72 comprises an elongated crescent-shaped strip of metal or the like having a thickness decreasing outwardly from its center toward its opposite ends. The vanes 72 each have an arcuate shape, and are positioned between the walls 69 and 70 by mounting bolts 74 and positioning bolts 75. The mounting bolts 74 are received through the centers of said vanes, and through preformed holes 76 in the walls 69 and 70, and then fastened into bosses 78 formed exteriorly on the inner wall 48 of the duct entrance portion (FIG. 2). The positioning bolts 75 are received through the exit portion outer wall 70, and fastened into the vanes 72 near the ends of the vanes. In this manner, the deswirl vanes 72 are accurately positioned between the walls 69 and 70, with the exit portion of the crossover duct 28 securely fastened to the inner wall 40 of the entrance portion. Then, the duct outer walls 50 and 70 are connected together by bolts 71 received through flanges 73 to complete a rigid crossover duct construction.

Figure 6:
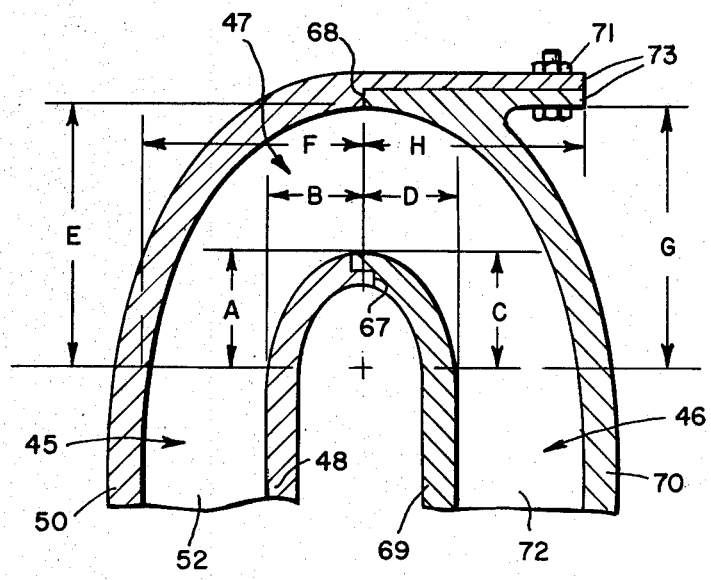
FIG. 6 is an enlarged fragmented elevation view of the turning bend of the duct.

The turning bend 47 of the crossover duct 28 is aerodynamically shaped for optimum efficiency of air passage without substantial turbulence or pressure loss. Specifically, as shown in FIGS. 2 and 6, the outer walls 50 and 70 of the crossover duct 28 and the inner walls 48 and 69 are shaped to comprise continuous turning wall geometries each having a modified generally semi-elliptical shape which is elongated relative to a conventional radially formed geometry. As shown in FIG. 6, the inner wall 48 is shaped to form one quadrant of an ellipse having a major and minor axis representatively identified in FIG. 6 by the letters (A) and (B), and the inner wall 69 is shaped to form a second quadrant of an ellipse having a major and a minor axis representatively identified by the letters (C) and (D). Together, the inner walls 48 and 69 form a continuous, semi-elliptical configuration forming the inner wall of the turning bend 47. In a similar manner, the outer wall 50 is shaped to form one quadrant of an ellipse which blends into a second quadrant formed by the exit portion outer wall 70. The major and minor axes of the outer wall quadrants are representatively identified by the letters (E) and (F), and (G) and (H), respectively. Importantly, for optimum aerodynamic performance, the ratio of the major and minor axes of the inner wall elliptical quadrants is at least about 1.20, and the ratio of the major and minor axes of the outer wall elliptical quadrants is at least about 1.15. These ratios have been found to provide relatively elongated turning bend wall geometries which reduce deleterious boundary layer effects through the turning bend, and thereby reduce crossover duct pressure losses.

A wide variety of modifications and improvements in the crossover duct of the invention are believed to be possible without varying from the scope of the invention. In particular, the duct may be used wherever it is necessary to smoothly and efficiently turn swirling gas flow from a radially outward to a radially inward direction. Further, the duct components may be cast, or formed from a wide variety of suitable materials and methods utilizing the same aerodynamic principles.

What is claimed is:

1. A crossover duct for turning radially outward gas flow to a radially inward direction comprising a duct entrance portion forming a radially outward gas flow path; a duct exit portion forming a radially inward gas flow path; and a turning bend of generally semi-elliptical cross section between said entrance and exit portions and having inner and outer walls forming a gas flow path for turning gas flow from a radially outward to a radially inward direction, said inner wall including a pair of generally elliptical quadrants each having a ratio of major to minor axis of at least about 1.20, and said outer wall including a pair of generally elliptical quadrants each having a ratio of major to minor axis of at least 1.15.

2. A crossover duct as set forth in claim 1 wherein said duct entrance portion comprises generally annular inner and outer walls and means for maintaining said annular walls in axially spaced relation to form an annular, radially outwardly directed gas flow path.

3. A crossover duct as set forth in claim 1 wherein said duct exit portion comprises generally annular inner and outer walls and means for maintaining said annular walls in axially spaced relation to form an annular, radially inwardly directed gas flow path.

4. A crossover duct as set forth in claim 1 wherein said duct entrance and exit portions and said turning bend are each formed from generally annular inner and outer walls whereby said radially outward, radially inward, and turning gas flow paths are generally annular in shape.

5. A crossover duct as set forth in claim 1 including a plurality of relatively thin diffuser vanes mounted within said radially outward gas flow path.

6. A crossover duct as set forth in claim 5 wherein said duct entrance portion includes annular inner and outer walls forming an annular, radially outwardly directed gas flow path, and said diffuser vanes are circumferentially spaced within said radially outward flow path.

7. A crossover duct a set forth in claim 6 wherein said diffuser vanes each have a length of at least about seventy-five times their thickness.

8. A crossover duct as set forth in claim 6 wherein said diffuser vanes each have a leading edge incident to radially outward gas flow, and a pressure surface and a suction surface, said suction surface being contoured adjacent the leading edge to form a leading edge wedge angle with respect to the pressure surface of at least about two degrees.

9. A crossover duct for turning radially outward gas flow to a radially inward direction comprising a generally annular, U-shaped inner wall; a generally annular, U-shaped outer wall; and means for maintaining said inner and outer walls in spaced relation to form a radially outward gas flow path, a turning bend for turning gas flow in said radially outward flow path to a radially inward direction, and a radially inward gas flow path, said turning bend of said inner and outer walls being generally semi-elliptical in shape and including a pair of generally elliptical quadrants with the ratio of major axes to minor axes of the inner wall quadrants being at least about 1.20 and the ratio of the major axes to minor axes of the outer wall quadrants being at least about 1.15.

10. A crossover duct as set forth in claim 9 including a plurality of relatively thin diffuser vanes mounted within said radially outward gas flow path.

11. A crossover duct as set forth in claim 10 wherein said diffuser vanes are circumferentially spaced within said radially outward gas flow path.

12. A crossover duct as set forth in claim 10 wherein said diffuser vanes each have a length of at least about seventy-five times their thickness.

13. A crossover duct as set forth in claim 10 wherein said diffuser vanes each have a leading edge incident to radially outward gas flow, and a pressure surface and a suction surface, said suction surface being contoured adjacent the leading edge to form a leading edge wedge angle with respect to the pressure surface of at least about two degrees.

14. A crossover duct for turning radially outward gas flow to a radially inward direction comprising a duct entrance portion forming a radially outward gas flow path; a duct exit portion forming a radially inward gas flow path; a turning bend of generally semi-elliptical cross section between said entrance and exit portions and having inner and outer walls forming a gas flow path for turning gas flow from a radially outward to a radially inward direction, said inner wall including a pair of generally elliptical quadrants each having a major axis to minor axis ratio of at least about 1.20, and said outer wall including a pair of generally elliptical quadrants each having a major axis to minor axis ratio of at least about 1.15; and a plurality of diffuser vanes mounted within said radially outward gas flow path, said diffuser vanes each having a leading edge incident to radially outward gas flow, and a pressure surface and a suction surface, said suction surface being contoured adjacent the leading edge to form a leading edge wedge angle with respect to the pressure surface of at least about two degrees.

15. A crossover duct as set forth in claim 14 wherein said duct entrance and exit portions and said turning bend are each formed from generally annular inner and outer walls whereby said radially outward, radially inward, and turning gas flow paths are generally annular in shape.

16. A crossover duct as set forth in claim 15 wherein said diffuser vanes are circumferentially spaced within said radially outward gas flow path.

17. A crossover duct as set forth in claim 14 wherein said diffuser vanes each have a length of at least about seventy-five times their thickness.

18. In a crossover duct for turning radially outward gas flow to a radially inward direction, a duct turning bend comprising a generally semi-elliptical inner wall; a generally semi-elliptical outer wall; and means for maintaining said inner and outer walls in spaced relation to each other to form a generally semi-elliptical gas flow path, said inner wall including a pair of generally elliptical quadrants each with a major axis to minor axis ratio of at least about 1.20, and said outer wall including a pair of generally elliptical quadrants each with a major axis to minor axis ratio of at least about 1.15.

19. In a multiple stage compressor having first and second compressor stages for serially compressing gas, a crossover duct for transferring radially outwardly directed compressor gas from said first stage to said second stage for further compression, comprising first means forming an annular, radially outwardly directed gas flow path for receiving compressed gas output from said first stage; second means for receiving the compressed gas output from said first means and for turning the gas output from a radially outward to a radially inward direction, said second means including annular inner and outer walls each having a generally semi-elliptical cross section and combining to form a generally semi-elliptical turning flow path, said inner wall being formed from a pair of generally elliptical quadrants each having a major axis to minor axis ratio of at least about 1.20, and said outer wall being formed from a pair of generally elliptical quadrants each having a major axis to minor axis ratio of at least about 1.15; and third means forming an annular, generally radially inwardly directed gas flow path for receiving the gas flow output from said second means and for supplying the same to said second compressor stage.

20. A crossover duct as set forth in claim 19 wherein said first means includes a plurality of circumferentially spaced diffuser vanes each formed to have a leading edge incident to the gas flow, and a pressure surface and a suction surface, said suction surface being contoured adjacent the leading edge to form a leading edge wedge angle with respect to the pressure surface of at least about two degrees.

* * * * *